US008579379B2

(12) United States Patent
Tamisier et al.

(10) Patent No.: US 8,579,379 B2
(45) Date of Patent: Nov. 12, 2013

(54) SEAT FOR A CHAIR LIFT INSTALLATION

(75) Inventors: Franckie Tamisier, La Guépière (FR); Philippe Martin, Voreppe (FR)

(73) Assignee: Pomagalski, Voreppe (FR)

( * ) Notice: Subject to any disclaimer, the term of this patent is extended or adjusted under 35 U.S.C. 154(b) by 287 days.

(21) Appl. No.: 12/924,402

(22) Filed: Sep. 27, 2010

(65) Prior Publication Data

US 2011/0277660 A1 Nov. 17, 2011

(30) Foreign Application Priority Data

Oct. 6, 2009 (FR) ..... 09 04766

(51) Int. Cl.
*A62B 35/00* (2006.01)

(52) U.S. Cl.
USPC ..... 297/487

(58) Field of Classification Search
USPC ..... 297/487, 488, 464; 104/173.2; 105/149.2
See application file for complete search history.

(56) References Cited

U.S. PATENT DOCUMENTS

| | | | | |
|---|---|---|---|---|
| 4,784,065 | A | 11/1988 | Brochand | 104/173.2 |
| 6,691,624 | B2 * | 2/2004 | Albrich | 105/149.2 |
| 8,047,137 | B2 * | 11/2011 | Blandon et al. | 104/173.2 |
| 2002/0043829 | A1 | 4/2002 | Switzeny | 297/184.12 |
| 2006/0131940 | A1 | 6/2006 | Coudurier | 297/330 |
| 2009/0058170 | A1 | 3/2009 | Switzeny | 297/487 |
| 2012/0068521 | A1 * | 3/2012 | Roodenburg et al. | 297/487 |

FOREIGN PATENT DOCUMENTS

| | | |
|---|---|---|
| EP | 0242242 A1 | 10/1987 |
| EP | 0242242 B1 | 5/1990 |
| EP | 0771708 A1 | 5/1997 |
| EP | 0808757 A1 | 11/1997 |
| EP | 0771708 B1 | 4/2000 |
| EP | 0808757 B1 | 8/2001 |
| EP | 1195305 A1 | 4/2002 |
| EP | 1195305 B1 | 4/2005 |
| EP | 1671867 A1 | 6/2006 |
| EP | 1671867 B1 | 10/2008 |
| EP | 2030858 A2 | 3/2009 |
| EP | 2030858 A3 | 3/2010 |

* cited by examiner

*Primary Examiner* — Milton Nelson, Jr.
(74) *Attorney, Agent, or Firm* — Bachman & LaPointe, P.C.

(57) ABSTRACT

The present invention relates to a seat for a chair-lift installation composed of a seating part (1) and a back (2) and further including a support arch (3) intended to be connected to a carrier cable, a safety bar (4) mounted to tilt with respect to the seat between a lowered position and a raised position and provided with a horizontal bar (5). According to the invention, the seat includes, at least one of the side flanks a tilting device (8) arranged so that the horizontal bar (5) of the safety bar (4) makes, in a side plane, a non circular motion facilitating the passage from the lowered position to the raised position and vice versa.

12 Claims, 1 Drawing Sheet

SEAT FOR A CHAIR LIFT INSTALLATION

This application claims benefit of priority to French patent application Ser. No. 09/04766, filed Oct. 6, 2009 which is incorporated by reference herein in its entirety.

TECHNICAL FIELD OF THE INVENTION

The present invention relates to the field of seats for chair lift installations.

Such seats are connected to an aerial carrier and hauling cable and are intended to receive passengers to be transported safely, whatever the climatic conditions, and in particular the seat positions and/or the movements that the passengers are liable to make during the transport.

The invention thus relates to a seat, for example a mechanical lift installation, composed of a back and a seating part, and further including a support arch intended to be connected to a carrier cable, and a safety bar mounted to tilt with respect to the seat between a lowered position and a raised position, and more particularly fitted with a horizontal bar.

STATE OF THE ART

Many seats of this type are known, wherein the safety bar is the element prohibiting, in the lowered position, any motion of the passengers' bodies, and securing an efficient holding in case of an important tilting of the seat during the transport. In addition, it must be possible to move the safety bar from this position as soon as the transport is completed, quickly, efficiently and easily for the passengers. In other words the safety bar, which is the essential safety element of the seats of chair lifts, must offer a reliable and simple utilisation by the passengers.

Document EP 0 242 242, for example, is known, which discloses a chair lift with seats coupled in line with an aerial cable. Each seat is coupled to the carrier cable through a tie bar with a detachable rope grip, which carries a metal frame of a seat with a back. A safety bar is knowingly articulated at one point located at the back of the seat back and is moved into the opening position by a tension spring and/or a counterweight. The safety bar is provided with a horizontal bar located in front of the passengers during transport. The horizontal bar pivots about an axis stationary with respect to the frame, and makes, in a side plane of the seat, a circle, the center of which is defined by the points of articulation of the safety bar on the seat back.

The dimensions of the safety bar must thus take into account hardly compatible constraints: on the one hand, the horizontal bar in the lowered position must be positioned at a small distance from the seat to provide a correct protective function, more particularly if the passenger is a child, whereas, on the other hand, it must move away into the raised position at a sufficient distance from the tallest passengers' heads, while remaining on its path between the two extreme positions, at a distance enabling the average users to hold it to guide it. The result is that selecting the articulations defining the stationary axis of rotation of the safety bar with respect to the frame is sometimes difficult and that compromises must be found.

SUMMARY OF THE INVENTION

The invention aims at remedying the disadvantages of the state of the art and more particularly provides a seat for chair lifts provided with an easily handled safety bar.

For this purpose, a seat is provided for a chair lift installation including a seating part, a back, a support arch intended to be connected to a carrier cable, a safety bar and a tilting device for tilting the safety bar with respect to the support arch between a lowered position and a raised position in a plane motion with one degree of freedom. According to the invention, the tilting device is arranged so that, when the safety bar tilts between the lowered position and the raised position, the safety bar pivots about an instantaneous rotation axis which moves with respect to the support arch perpendicularly to itself.

Plane motion means a motion wherein all the points of the solid constituted by the safety bar have spot speed vectors which remain, on the whole path, parallel to a reference plane stationary with respect to the support arch. Such reference plane is, in practice, a cross-sectional plane of the seat.

Providing a not stationary instantaneous rotation axis, results in the safety bar being close to the seat back and to the seating part in the lowered position, and moves away to a high position, which is far enough from the seating part in the raised position.

More particularly, the instantaneous rotation axis of the safety bar with respect to the arch is provided so as to move with respect to the support arch, frontward and upward, when the safety bar moves from the lowered position to the raised position. More precisely, "frontward" means, as the persons skilled in the art will understand it, in the direction faced by the back of the seat, whereas "upward" means in the direction faced by the seating part in operational position.

In a particular embodiment, the displacement of the instantaneous axis is above 5 cm, and more generally between and 15 cm, between the extreme lowered and raised positions. The frontward displacement of the instantaneous rotation axis is preferably greater than 5 cm, for example of the order of 5 to 15 cm. The same order of magnitude is true upwards. The path of the instantaneous rotation axis may be almost circular.

According to a preferred embodiment of the invention, the path of any point of the safety bar with respect to the support arch is provided so as to be very close to an elliptical arch, during the passage from the lowered position to the raised position.

According to a preferred embodiment of the invention, the tilting device includes at least a first crank mechanism including a first connecting rod pivoting about a first vertical axis stationary with respect to the support arch and a first vertical axis stationary with respect to the safety bar, and a second connecting rod pivoting about a second vertical axis stationary with respect to the support arch and a second vertical axis stationary with respect to the safety bar. It should be understood that both connecting rods constitute, with the support arch and the safety bar, a link quadrangle, the four summits or pivots of which are formed by the four pivoting axes of both connecting rods, which are all parallel to the reference transversal axis.

Such a mechanism makes it possible to provide the expected motion with extremely simple and robust means. The axes stationary with respect to the support arch may be located relatively low, i.e. close to the seating part of the seat, without affecting the clearance upward of the safety bar, in the raised position.

The first vertical axis stationary with respect to the support arch and the second vertical axis stationary with respect to the support arch are spaced by a distance d1.

The first vertical axis stationary with respect to the safety bar and the second vertical axis stationary with respect to the safety bar are spaced by a distance d2, different from d1, which means that the link quadrangle is not a parallelogram. According to one embodiment, the distance d1 is greater that the distance d2. More precisely, the distances d1 and d2 may be 5 cm to 15 cm.

Alternately or simultaneously, the dimensions of the connecting rods are different.

According to one embodiment, the connecting rods do not cross at any point of their paths, when the safety bar moves from the lowered position to the raised position.

According to one embodiment, the dimensions of, the connecting rods and the clearance between the rotation axes are such that, in the lowered position, the first vertical axis stationary with respect to the safety bar is positioned in a plane defined by the second vertical axis stationary with respect to the safety bar and the second vertical axis stationary with respect to the support arch, or at a distance from this plane of less than 2 cm.

According to one embodiment, the dimensions of the connecting rods and the clearance between the rotation axes are such that, in the raised position, the second vertical axis stationary with respect to the safety bar is positioned in a plane defined by the first vertical axis stationary with respect to the safety bar and the first vertical axis stationary with respect to the support arch, or at a distance from this plane of less than 2 cm.

The safety bar preferably includes at least one cross-bar extending from a first side end of the seat to a second side end of the seat.

The first crank mechanism is preferably positioned at one side end of the seat and the tilting device further includes a second crank mechanism similar to the first crank mechanism and positioned at the other side end of the seat.

In practice, the connecting rods can be directly or indirectly fixed to the support arch, on the one hand and to the safety bar, on the other hand. Fixing can be, for example, through fixing brackets, provided with bores defining the rotation axes. On the support arch side, fixing may be on the arch itself or on the side of the seat back, which is itself stationary with respect to the support arch.

Advantageously, the safety bar includes at least a support device to be used as a foot rest or a ski rest.

BRIEF DESCRIPTION OF THE FIGURES

Other characteristics, objects and advantages of the present invention will appear upon reading the following description and referring to the appended drawings, wherein.

For more clarity, identical or similar elements are referred to using identical reference signs on all the figures.

DETAILED DESCRIPTION OF ONE EMBODIMENT

Figure 1:
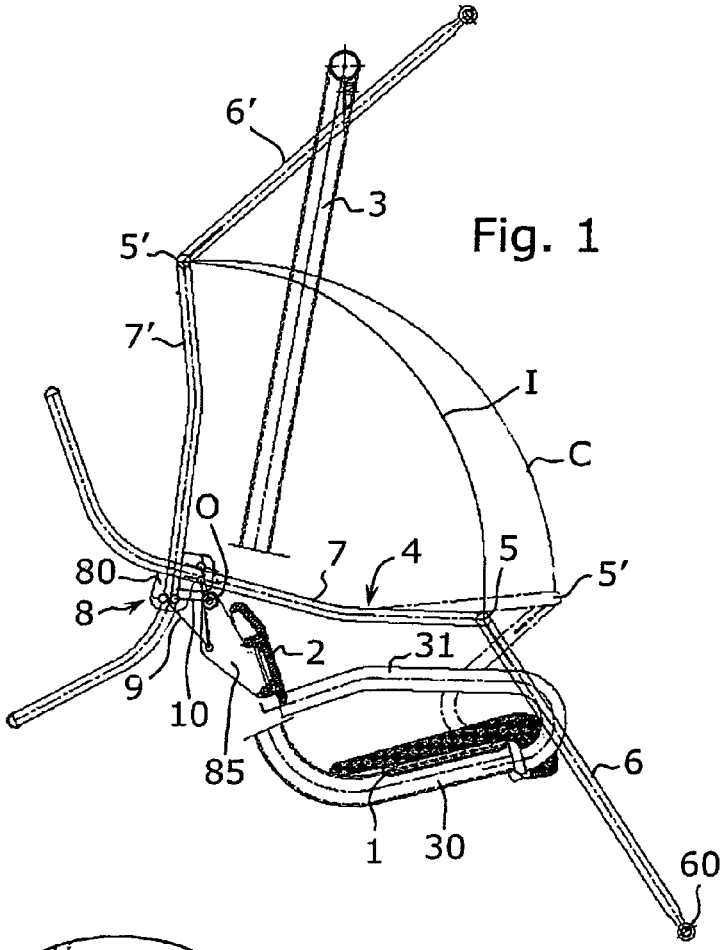
FIG. 1 shows a schematic cross-sectional view of the seat according to one embodiment according to the invention.

FIG. 1 shows a simplified side view of a seat according to the invention, composed of a seating part 1 and a back 2. A support arch 3 is further used as a connection part between the seat and a carrier cable, not shown. The arch 3 is generally connected to an intermediate part called a tie bar, which is directly coupled to the support cable, through a rope grip, detachable or not. The tie bar thus carries the generally metallic arch or frame 3 of the seat itself.

On the side, the frame or arch 3 can compose the back 2 framework, a lower support 30 for the seating part 1, as well as an arm-rest 31. The seating part can be mounted stationary or tilting with respect to the arch. The frame or arch 3 can be made of a metallic tube having appropriate dimensions.

A safety bar 4 is provided for, and mounted to tilt with respect to the arch, more precisely between a so-called lowered position and a so-called raised position.

The lowered position corresponds to the one illustrated in dark lines in FIG. 1, whereas the raised position corresponds to the one illustrated in lighter lines. The safety bar 4 is knowingly provided with a horizontal bar 5 positioned in the lowered position in front of the passengers, waist-high, so as to prevent them from sliding frontward of the seat.

The safety bar includes at least a first tubular element 6 which extends from the horizontal bar 5, towards the lower part of the seat and generally ends in a foot rest 60. When the safety bar 4 is in the lowered position the tubular element 6 rests against the seating part 1 of the seat. When the safety bar 4 is in the raised position the tubular element 6' is illustrated in lighter lines.

On the side, the safety bar 4 includes a second tubular element 7 associated with a tilting device 8 which will be described in greater details, while referring to FIG. 2.

Figure 2:
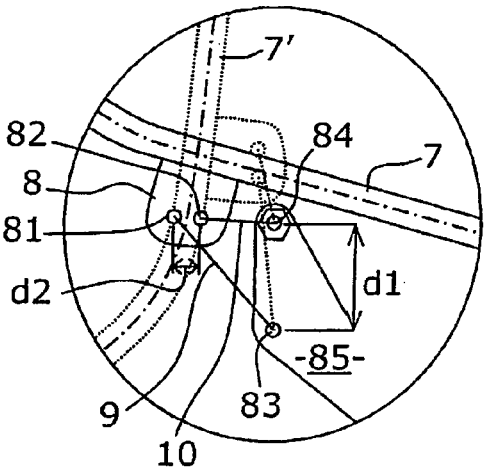
FIG. 2 shows an enlarged view of the tilting device according to the invention.

In FIG. 2, bold lines show the tilting device in the lowered position, and lighter lines show the device in the raised position. More precisely, the second tubular element is indicated 7 in the lowered position and 7' in the raised position.

A part or lug 80 is fixed to the second tubular element 7: it includes a first 81 and a second 82 bore, each being respectively engaged into a first and a second material axis of a first 9 and a second 10 connecting rod.

The second end of each connecting rod 9, 10 is composed of a material axis engaged into, respectively, a first 83 and a second 84 bore of a part or a lug 85 connected to the back 2.

The distance d1 between the rotation axes defined by the bores 83 and 84 of the lug 85 is provided greater than the distance d2 between the rotation axes defined by the bores 81 and 82 of the lug 80.

The parts or lugs 80, 85 are parallel and belong to a side plane of the seat.

The lugs and connecting rods together compose a tilting device 8 enabling the safety bar 4 to move between two respectively lowered and raised positions.

The instantaneous rotation axis of the safety bar with respect to the fixed reference composed by the support arch is always the intersection of the plane containing the axes defined by the bores 81 and 83, i.e. the rotation axis of the connecting rod 9, with the plane containing the axes defined by the bores 82 and 84, i.e. the rotation axis of the connecting rod 10. It can be noted that, in the lowered position, the axes of the bores 81, 82 and 84 are in the same plane, with the bore 82 being between the two other ones. In this position, the instantaneous rotation axis of the safety bar with respect to the support arch is identical with the axis of the bore 81. In the raised position, the axes of the bores 81 and 82 are in the same plane as the axis of the bore 83, with the bore 81 being between the two other ones. In this position, the instantaneous rotation axis of the safety bar with respect to the support arch is identical with the axis of the bore 82. When the safety bar moves from the lowered position to the raised position, the instantaneous rotation axis thus moves frontward and upward from the seat. The path of the instantaneous rotation axis, and more generally that of the safety bar, is reversed when the safety bar moves from the raised position to the lowered position.

However, such provision is not limitative. As a matter of fact, a slight shift may exist between the axes, in both travel end positions.

End stops (not shown) of course make sure that the safety bar does not leave its motion range between the lowered position and the raised position. The motion of the safety bar and/or the holding in the raised position thereof can, knowingly and if required, be facilitated by a counterweight and/or spring device. The motion can, if required, be motorized or automated, for example using a cam system when the seat reaches the resort.

As the tilting is not provided by the rotation of the safety bar 4 about a stationary axis of rotation (as is known), but by a relative motion of two connecting rods 9, 10 respectively associated with one element 7 of the safety bar 4 and with the support arch, the motion of the safety bar is optimum as regards the usability. More particularly, the horizontal bar 5 of the safety bar 4 describes a non-circular motion in a side plane of the seat.

FIG. 1 illustrates this difference when considering lines C and I: C is the known circular path of the horizontal bar 5 about a single center of rotation O, considering as profile of the bar 5', drawn in mixed lines; I is the path of the same bar 5 according to the invention.

The path obtained according to the invention substantially improves the tilting of the safety bar 4, in the opening direction as well as in the closing direction.

What is claimed is:

1. A seat for a chair lift installation including a seating part, a back, a support arch intended to be connected to a carrier cable, a safety bar and a tilting device for tilting the safety bar with respect to the support arch between a lowered position and a raised position in a plane motion with one degree of freedom, characterized in that the tilting device is arranged so that, when the safety bar tilts between the lowered position and the raised position, the safety bar pivots about an instantaneous rotation axis which moves with respect to the support arch perpendicularly to itself.

2. A seat according to claim 1, characterized in that the tilting device is arranged so that the instantaneous rotation axis moves, with respect to the support arch to the front and the top of the seat, when the safety bar moves from the lowered position to the raised position.

3. A seat according to claim 1, characterized in that the instantaneous rotation axis moves by more than 5 cm with respect to the support arch, when the safety bar moves from the lowered position to the raised position.

4. A seat according to claim 1, characterized in that the safety bar includes at least one cross-bar extending from a first side end of the seat to a second side end of the seat.

5. A seat according to claim 1, characterized in that said seat includes an end stop defining the raised position and an end stop defining the lowered position.

6. A seat according to claim 1, characterized in that the tilting device includes at least a first crank mechanism including a first connecting rod pivoting about a first vertical axis stationary with respect to the support arch and a first vertical axis stationary with respect to the safety bar, and a second connecting rod pivoting about a second vertical axis stationary with respect to the support arch and a second vertical axis stationary with respect to the safety bar.

7. A seat according to claim 6, characterized in that the first and second connecting rods each have a path and do not cross at any point of paths, when the safety bar moves from the lowered position to the raised position.

8. A seat according to claim 6, characterized in that the first crank mechanism is positioned at a first side end of the seat and in that the tilting device further includes a second crank mechanism similar to the first crank mechanism and positioned at a second side end of the seat.

9. A seat according to claim 6, characterized in that the first vertical axis stationary with respect to the support arch and the second vertical axis stationary with respect to the support arch are spaced by a distance d1 and in that the first vertical axis stationary with respect to the safety bar and the second vertical axis stationary with respect to the safety bar are spaced by a distance d2, different from d1.

10. A seat according to claim 9, characterized in that the distance d1 is greater than the distance d2.

11. A seat according to claim 9, characterized in that the dimensions of the connecting rods and the clearance between the rotation axes are such that, in the lowered position, the first vertical axis stationary with respect to the safety bar is positioned in a plane defined by the second vertical axis stationary with respect to the safety bar and the second vertical axis stationary with respect to the support arch, or at a distance from this plane of less than 2 cm.

12. A seat according to claim 9, characterized in that the dimensions of the connecting rods and the clearance between the rotation axes are such that, in the raised position, the second vertical axis stationary with respect to the safety bar is positioned in a plane defined by the first vertical axis stationary with respect to the safety bar and the first vertical axis stationary with respect to the support arch, or at a distance from this plane of less than 2 cm.

* * * * *